United States Patent [19]

Fox

[11] 4,392,338

[45] Jul. 12, 1983

[54] PACKETS AND THE MANUFACTURE THEREOF

[75] Inventor: Austin L. Fox, London, England

[73] Assignee: Molins Limited, London, England

[21] Appl. No.: 209,614

[22] Filed: Nov. 24, 1980

Related U.S. Application Data

[63] Continuation of Ser. No. 956,159, Oct. 31, 1978, abandoned, which is a continuation-in-part of Ser. No. 775,023, Oct. 7, 1977, abandoned.

[30] Foreign Application Priority Data

Mar. 15, 1976 [GB] United Kingdom ..... 10324/76
Nov. 8, 1977 [GB] United Kingdom ..... 46491/77

[51] Int. Cl.[3] ..... B65B 11/48; B65D 5/66; B65D 85/10

[52] U.S. Cl. ..... 53/462; 53/207; 53/491; 206/268; 229/44 CB; 493/911

[58] Field of Search ..... 229/37 R, 37 E, 44 CB; 206/268; 493/911; 53/462, 207, 484, 491

[56] References Cited

U.S. PATENT DOCUMENTS

| | | | |
|---|---|---|---|
| 2,872,097 | 2/1959 | Graybill | 229/44 CB |
| 3,438,564 | 4/1969 | Moreton | 229/44 CB |
| 3,529,763 | 9/1970 | Wagner | 229/44 CB |
| 3,858,788 | 1/1975 | Philips, Jr. | 229/44 CB |
| 3,874,581 | 4/1975 | Fox et al. | 229/44 CB |
| 3,933,299 | 1/1976 | Shimada et al. | 229/44 CB |
| 3,944,066 | 3/1976 | Niepmann | 229/44 CB |
| 3,977,157 | 8/1976 | Davies et al. | 53/207 |
| 3,979,047 | 9/1976 | Focke et al. | 229/44 CB |

FOREIGN PATENT DOCUMENTS

| | | | |
|---|---|---|---|
| 582207 | 8/1959 | Canada | 229/44 CB |
| 1142545 | 1/1963 | Fed. Rep. of Germany | 229/44 CB |
| 1204133 | 10/1965 | Fed. Rep. of Germany | 229/44 CB |
| 948790 | 2/1964 | United Kingdom | 229/44 CB |
| 1459091 | 12/1976 | United Kingdom | 229/44 CB |

*Primary Examiner*—Allan N. Shoap
*Attorney, Agent, or Firm*—John C. Smith, Jr.

[57] ABSTRACT

A hinged lid packet has an integral inner frame comprising a recessed panel extending upwardly from the front wall of the body of the packet, and a pair of side flaps extending backwards from the sides of the recessed panel. A cut-away part is formed at the top of each side flap to provide access for securing each outer flap of the lid of the packet to the respective inner flap. Each inner flap may be of a shape corresponding to the cut-away part, so that with the lid closed the inner flap and the respective side flap are substantially contiguous.

4 Claims, 14 Drawing Figures

117
118
119
116
107
108
120
121
122
L
M

PACKETS AND THE MANUFACTURE THEREOF

This is a continuation of application Ser. No. 956,159 filed Oct. 31, 1978, now abandoned, which is a continuation-in-part of application Ser. No. 775,023 filed Oct. 7, 1977, now abandoned.

This invention relates to packets, in particular hinged lid packets, and to improvements in the manufacture thereof.

In British Patent Specification No. 1,431,173 (German Offenlegungsschrift No. 2,332,438) there is disclosed a hinged lid packet for cigarettes having an integral recessed panel extending from the front wall of the body portion, in place of a conventional separate inner frame.

One common manner of producing hinged lid packets involves forming a packet blank around a bundle of cigarettes in a sequence of operations, for example as disclosed in British Patent Specification No. 1,459,091. The final operation merely requires the outer flaps of the body and lid portions to be folded down and secured against the sides of the packet. A packet as disclosed in the first mentioned Specification No. 1,431,173 cannot be formed in such a way, and would require a different, and possibly less efficient, manner of production.

It is an object of the invention to provide a hinged lid packet, and a blank therefor, which can be efficiently made in the aforementioned manner utilising packing machinery similar to that commonly used.

According to the present invention there is provided a hinged lid packet with a lid portion hinged to a body portion, the body portion comprising a front wall, a rear wall, a pair of side walls each formed by an inner flap extending from the rear wall and by an outer flap extending from the front wall, a recessed panel extending upwardly from the front wall, a pair of side flaps extending from the sides of the recessed panel and being recessed inwardly parallel thereto, and means securing each side flap to at least one of said inner and outer flaps; the lid portion comprising a front wall, a rear wall hinged to the rear wall of the body portion, and a pair of side walls each formed by an inner flap extending from the rear wall and by an outer flap extending from the front wall; wherein the top of each said side flap is formed with a cut away part, so that on completing the formation of the packet with the lid portion closed, access is provided for securing together the respective inner and outer flaps of the lid portion.

The invention also extends to a one-piece blank for forming such a hinged lid packet.

It is to be understood throughout this specification that expressions such as "upwardly", "lower", "horizontal" etc., whether referring to the packet or to the blank, are to be construed in relation to the packet when standing in an upright position.

Figure 1:
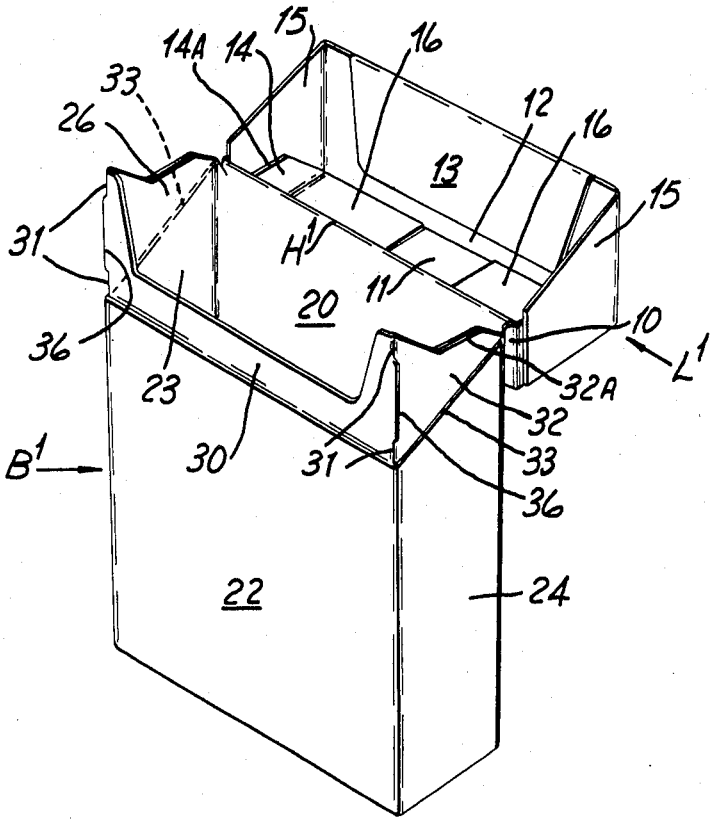
Figure 2:
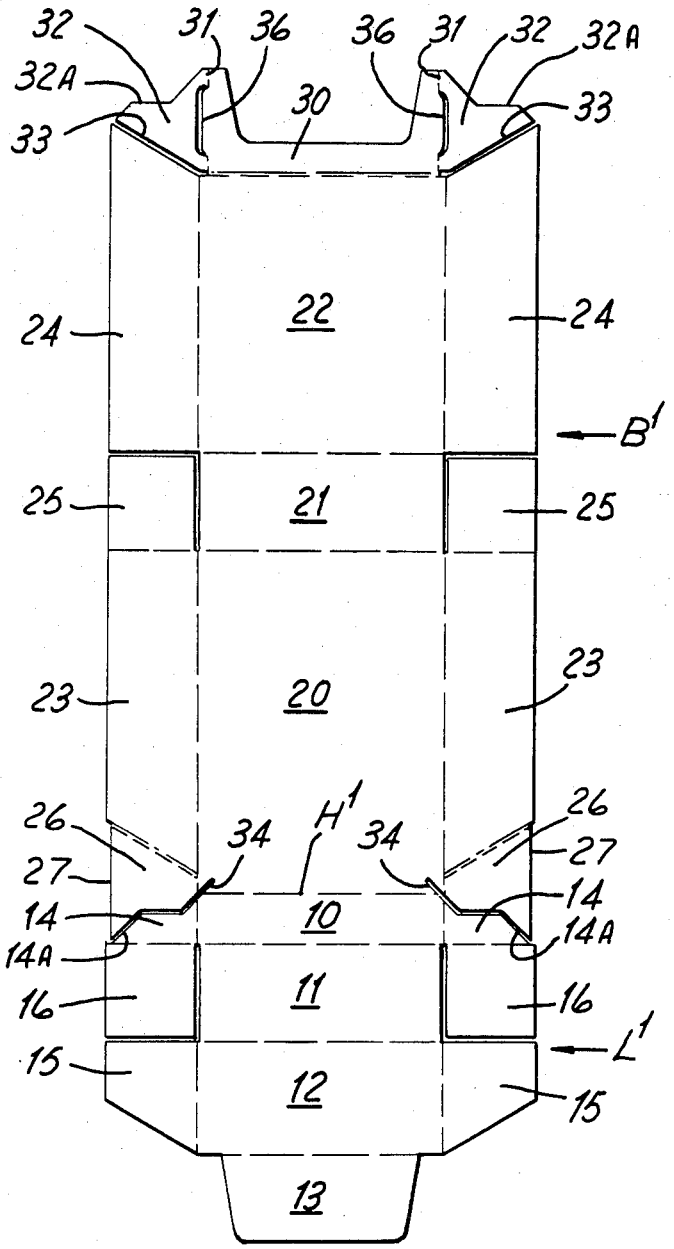
Figure 3:
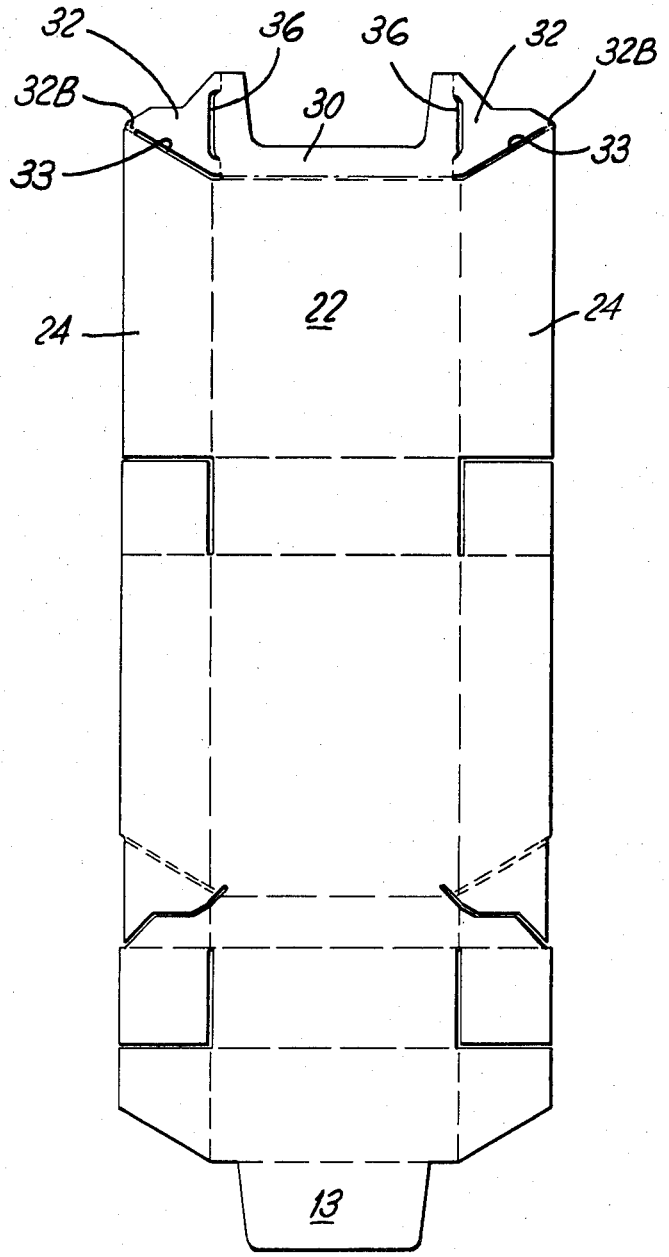
Figure 4:
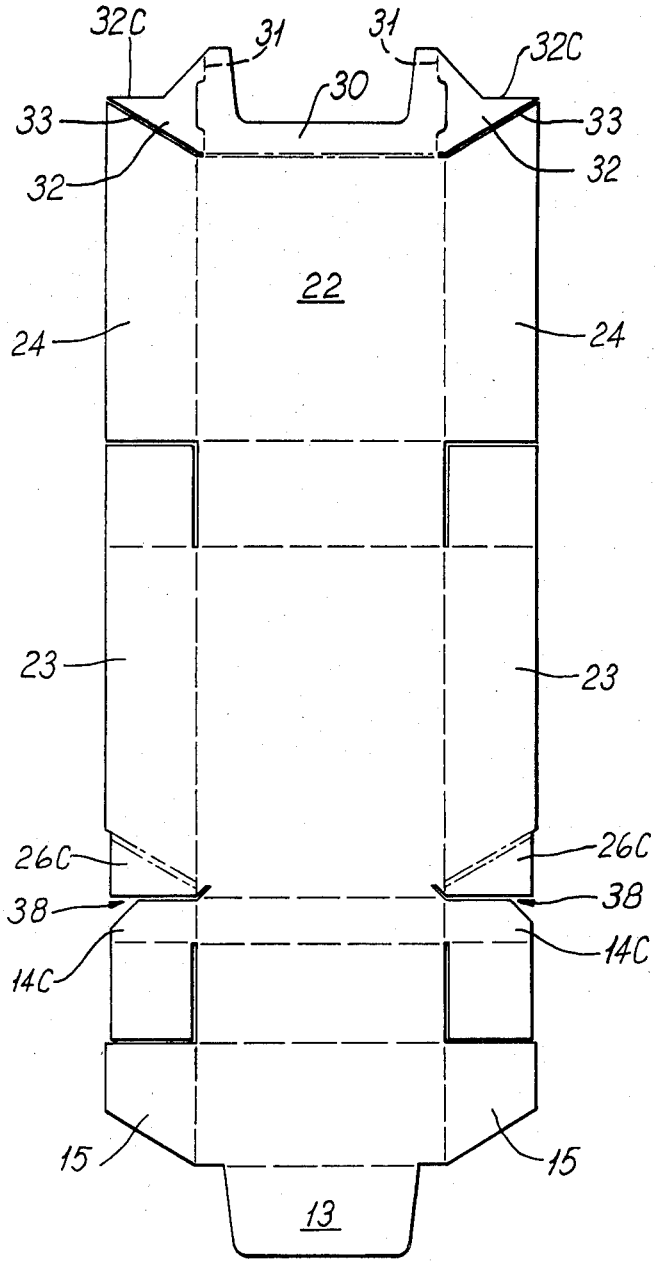
Figure 5:
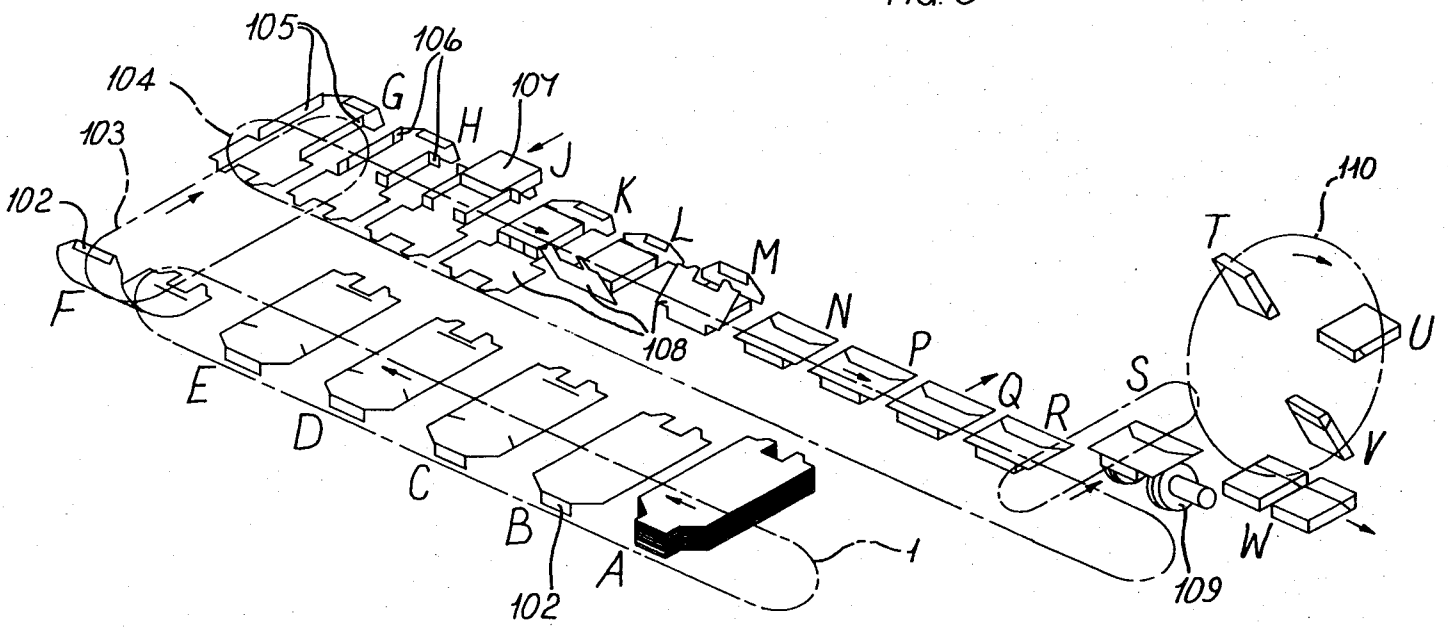
Figure 6:
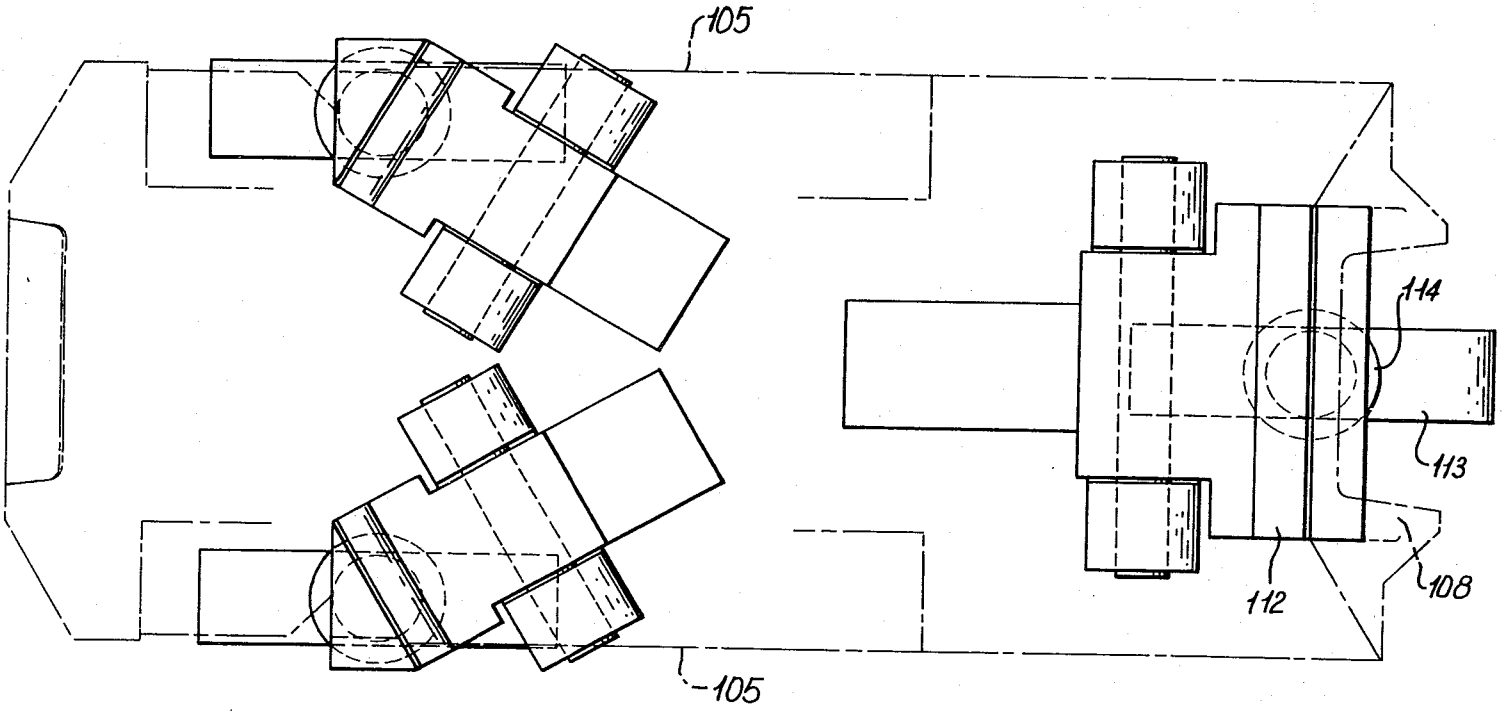
Figure 7:
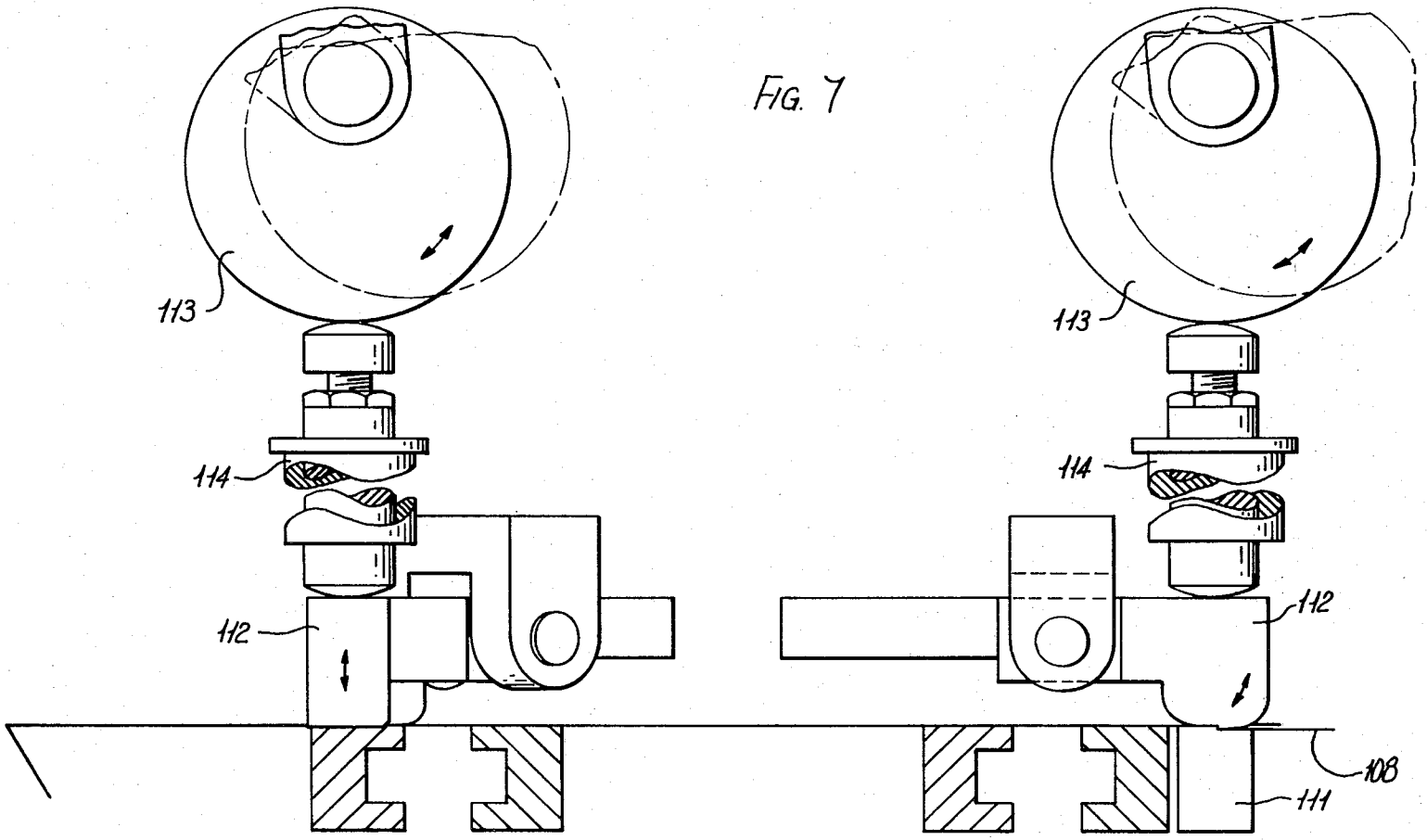
Figures 8, 9, 10, 11, 12:
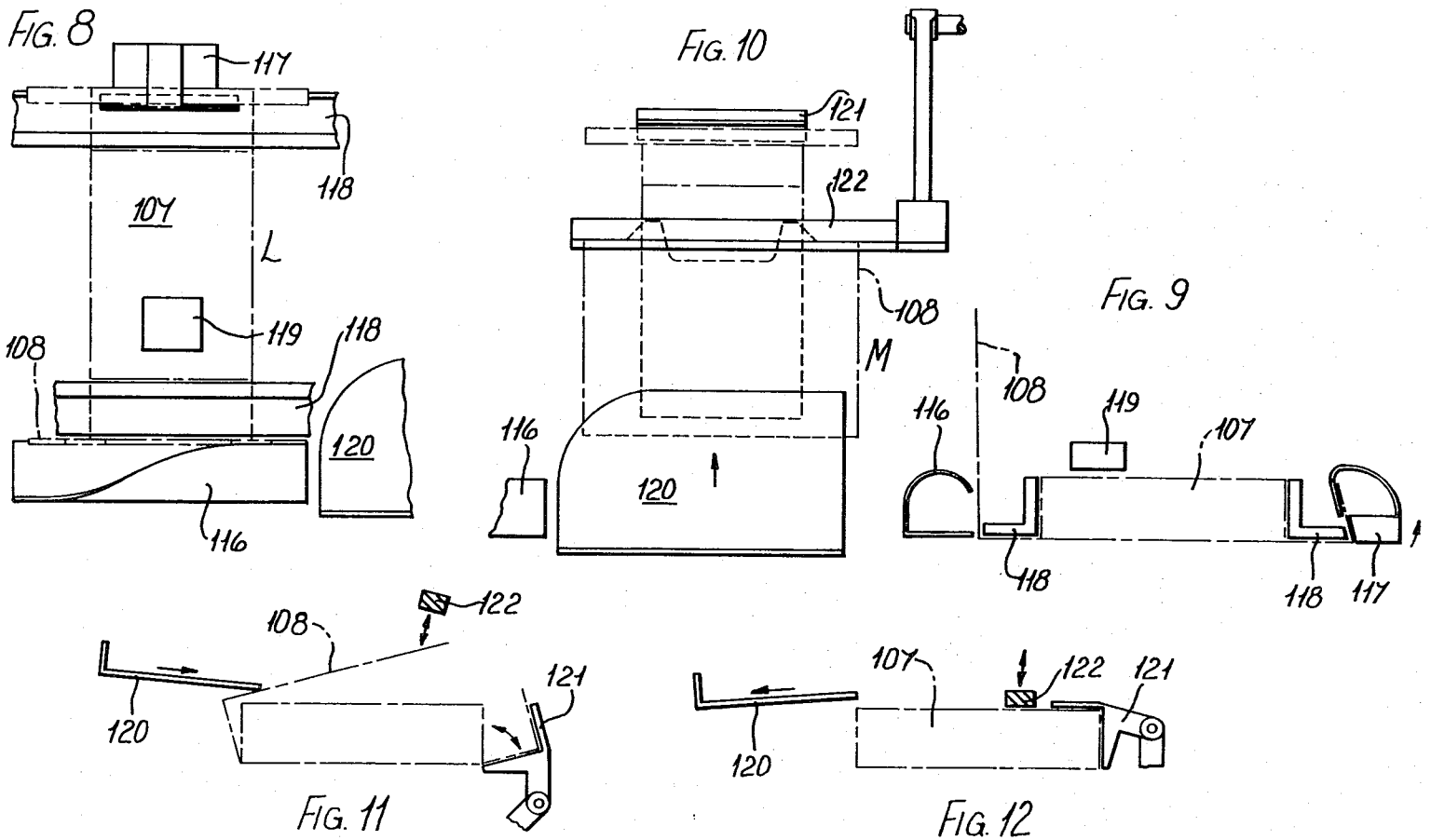
Figure 13:
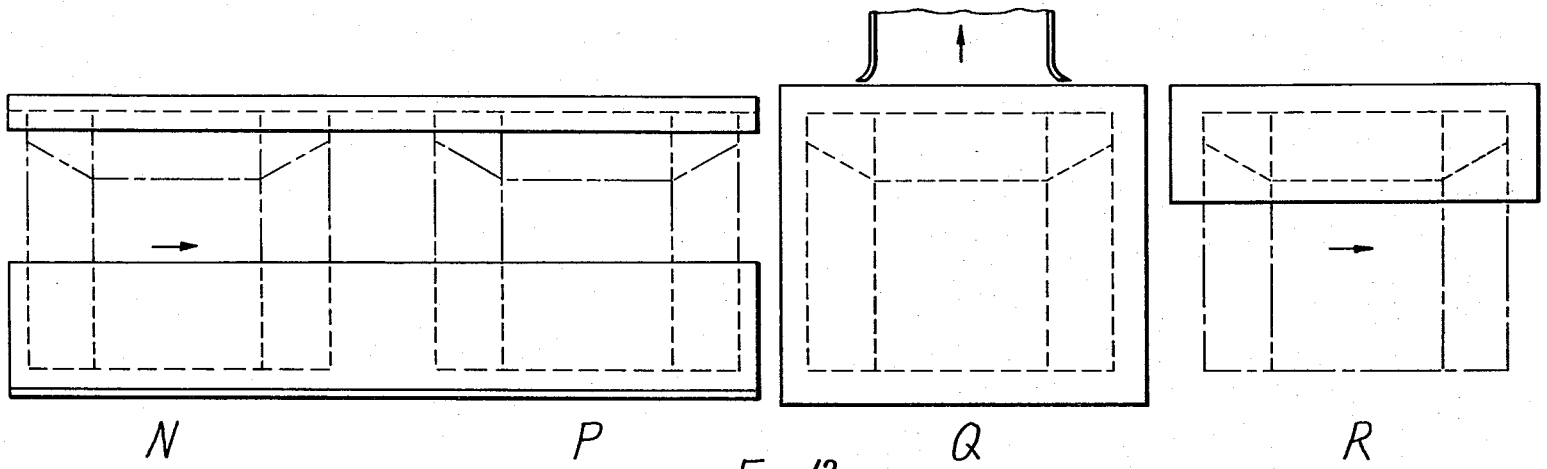
Figure 14:
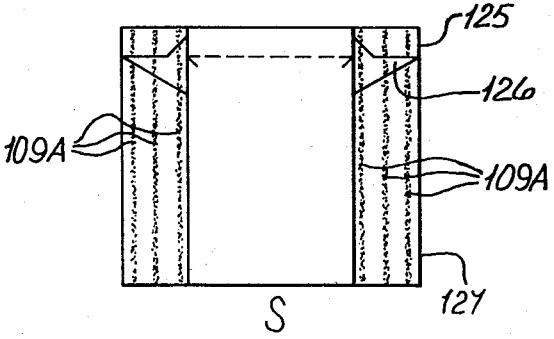

An example of a packet according to the invention will now be described with reference to the accompanying drawings, in which:

FIG. 1 is a perspective view of the packet standing upright,

FIG. 2 is a view, drawn to a slightly smaller scale, of the blank from which the packet of FIG. 1 is made, FIG. 3 is a modification of the blank of FIG. 2, drawn to the same scale, FIG. 4 is a further modification of the blank of FIG. 2, FIG. 5 is a perspective view of the various stages in a method of forming the hinged lid packets, FIG. 6 is a plan view of an embossing device at station C of FIG. 5, FIG. 7 is a side view of the device of FIG. 6, FIG. 8 is a plan view of a folding device at station L of FIG. 5, FIG. 9 is a side view of the device of FIG. 8, FIG. 10 is a plan view of a folding device at station M of FIG. 5, FIG. 11 is a side view of the device of FIG. 10, FIG. 12 is a further side view of the device of FIG. 10 at the end of its motion, FIG. 13 is a plan view of apparatus at stations N, P, Q and R of FIG. 5, and FIG. 14 is a view from underneath of a packet at station S of FIG. 5.

As the packet shown in FIG. 1 is in many respects similar to the packet described in the aforementioned Specification No. 1,431,173, the same reference numerals have been retained where possible. The packet is made from the single cardboard blank shown in FIG. 2, and comprises essentially a lid L integrally hinged along a line H to a body B.

The lid L includes a rear wall 10, a front wall 12, and a reinforcing panel 13 secured to the inside of the wall 12. Inner flaps 14 (described in further detail below) and outer flaps 15 extend from each side of the rear wall 10 and front wall 12 respectively, and are secured together to form the side walls of the lid. A further flap 16 extends from each inner flap 14 and is secured to the inside of the top panel 11.

The body B includes a rear wall 20, a base 21, and a front wall 22. Inner and outer flaps 23 and 24 extend from the rear wall 20 and front wall 22 respectively, and are secured together to form the side walls of the body. A flap 25 extends from each inner flap 23 and is secured to the inside of the base 21. The top portion 26 of each inner flap 23, as viewed in FIG. 1, is deformed or recessed inwardly parallel to the bottom portion by an amount corresponding to the thickness of the blank. Small trimming cuts 27 are provided at the outer edges of the deformed portions 26.

A recessed panel 30 extends upwardly from the front wall 22 and is preferably likewise deformed inwardly parallel to the wall 22 by the thickness of the blank. The width of the panel 30, which is defined by corner fold lines 31, is smaller than that of the front wall 22, and this difference in width is shown exaggerated in FIG. 2.

Extending from each fold line 31 is a side flap 32 which is adhesively secured to the respective deformed portion 26 of the adjacent inner flap 23. The trimmed edges 27 of the portions 26 are accommodated in the corners between the panel 30 and the side flaps 32.

Other features, which are conventional, are the short inclined slits 34 at the ends of the hinge line H, to facilitate opening of the lid, and ears 36 formed at the middle of the fold lines 31 to bear frictionally against the sides of the lid L to maintain it closed.

Referring again to the side flaps 32, it will be seen that the top of each flap has a cut away part shown by a staggered line 32A and consisting of a line sloping downwardly from the panel 30, a horizontal line, and a further short inclined line. Thus the height of each side flap 32 reduces in stages towards the rear of the packet, in comparison with the constant height of the comparable side flaps shown in Specification No. 1,431,173. The top of the deformed portion 26 of each inner flap 23 is similarly shaped, so that it is substantially in alignment with the line 32A. Thus, as best seen from FIG. 2, each inner flap 14 of the lid L is of a shape complementary to that of the deformed portion 26, and therefore complementary also to the shape of the top of the flap 32.

When the lid L is closed, the inner surface of each outer flap 15 bears against the outer surface of the respective side flap 32, and each inner flap 14 is substantially in abutment with the top of the respective side flap 32, i.e. the line 32A and the line 14A, which defines the lower edge of the inner flap 14, become substantially contiguous.

The purpose of the cut away part of the side flap 32 will become apparent from a brief description of the manner in which the relevant parts of the blank are folded to form the packet of FIG. 1.

During the main stages of the folding of the blank—see for example FIGS. 24 to 30 of British Specification No. 1,459,091—the inner flaps 23 and the front wall 22 of the body, and the inner flaps 14 and the front wall 12 of the lid are already formed about a bundle of cigarettes to be contained by the packet. The final stage of forming the packet involves the folding down and adhesively securing of the side flaps 32, the outer flaps 24 of the body, and the outer flaps 15 of the lid to the respective parts of the packet; thus the outer flaps 24 are secured to the inner flaps 23, the side flaps 32 secured to the portions 26, and the outer flaps 15 of the lid are secured to the inner flaps 14. These folding and securing operations may all be performed simultaneously; furthermore the application of adhesive to all the flaps may also be performed in a single operation.

It will be seen that the manner of forming the packet just described would not be possible if each side flap 32 were of constant heights as those shown in Specification No. 1,431,173. By having a cut away 32A in the side flaps, the outer flaps 15 can be secured to the inner flaps 14 while the lid remains closed and without the side flaps 32 intervening.

As an alternative to the procedure outlined above, each side flap 32 may instead be folded and secured to the portion 26 before the flaps 24 and 15 are folded and secured, so that each lower edge 33 of the flap 32 becomes sandwiched between the inner and outer flaps 23 and 24.

In a modification of the blank of FIG. 2 shown in FIG. 3 (in which only the relevant reference numerals are indicated), the end of each flap 32 remote from the panel 30 is attached to the adjacent part of the respective outer flap 24 by a narrow connecting land 32B of about 3 mm length; thus the cut defining the lower edge 33 of each flap is closed at the outer end. Each flap 32 (FIG. 3) is set inwardly relative to the respective flap 24 by inward deformation along the connecting land 32B, so that in the erect packet the flap 32 is held against the inwardly deformed portion 26, to which it may also be secured by adhesive. Thus in the finished packet (as also in the packet of FIG. 1) each outer flap 15 of the lid, when closed, will be flush with the respective outer flap 24 of the body, since the side wall of the lid is only of a single thickness where it bears against the flap 32. This gives a neater appearance at the sides of the packet than is the case with conventional packets, or with a packet as disclosed in Specification No. 1,431,173 where the relevant part of the side walls are of double thickness.

FIG. 4 shows a further modification of the blank of FIG. 2. The side flaps 32 are each formed with a larger cut away part, indicated by the line 32C. The horizontal part of the line 32C is lower compared with that in FIGS. 2 and 3, such that it meets the end of the lower edge 33 of the flap 32. Also the inclined part of the line 32C is nearer the panel 30, so that it cuts across each corner fold line 31, thereby providing a lead-in to guide the closing of the lid.

The complementary inner flaps 14C of the lid is thus also correspondingly larger in area, so providing improved adhesion between the inner and outer flaps 14C and 15.

FIG. 4 shows also a modified shape of the deformed portion 26C of each inner flap 26. As shown at 38, a triangular part is removed from the portion 26C, so that in the erect packet the top edge of the portion 26C is aligned only with the horizontal part 32C of the flap 32. If any misalignment should occur between the flap 32 and the portion 26C such that the portion 26C is higher than the flap 32, then this will be less noticeable than if the triangular part 38 were attached to the portion 26C.

It will be seen that in each of the blanks of FIGS. 2 to 4 the reinforcing panel 13 is of a shape corresponding to the cut out in the recessed panel 30. This enables the blanks to be made with less wastage of material, since in stamping out a succession of blanks from a strip of material the reinforcing panel can be made to nest with the cut out in the recessed panel of the next blank.

Referring now to FIG. 5, hinged lid blanks are held in a stack at a station A and are fed singly on to a horizontal blank conveyor 101 which is movable in steps past subsequent stations. The blanks are so-called "one-piece blanks" of the type described above.

At station B a lid reinforcing flap 102 on each blank is bent downwardly, and at station C three portions of the blank are deformed by an embossing unit to be described below. After passing stations D and E, the blank is engaged at F by a transfer conveyor 103 which completes the folding of the flap 102 and transfers the blank to a further horizontal indexable conveyor 104 formed with pockets.

In being pushed down into a pocket at station G, the inner side walls 105 of the blank are folded upwards. At station H flaps 106 at the end of the side walls adjacent the lid are opened out in readiness for a bundle of cigarettes 107 to be delivered at station J into the thus partly formed packet. At station K the flaps are folded around the bundle, and in moving to station L the front wall 108 of the body is folded upwards. The presence of the bundle 107 is also checked by a detector at station L. The front wall 108 is then fully folded against the bundle at station M before the front wall of the lid is folded thereover. No further folding is performed at stations N and P, while at station Q the partly formed packet may be ejected, if for example no bundle has been detected at station L.

After station R the packet is transferred to an overhead conveyor where, as shown at S, lines of adhesive are applied by a gumming wheel 109 to each of the protruding flaps. The packet then enters a drying drum 110, in which the protruding flaps are folded over and held against the sides of the packet. The adhesive is allowed to dry at a plurality of stations, three of which are shown at T, U and V. At station W the completed packet leaves the drum 110 and moves sideways towards apparatus for overwrapping the packet.

While much of the apparatus for performing the above packing operations may be similar to that of the packing machines known as the Molins HLP 1 and HLP 2 machines, certain different parts of the apparatus in accordance with the invention will now be described.

The embossing device at station C will first be described, with reference to FIGS. 6 and 7. This device deforms or embosses three portions of the blank, namely the front wall 108 and two inner side walls 105; the purpose of such deformations is apparent from the above description of the blank. As a similar embossing unit is used for each of these three portions, only the one for the front panel will be described.

The portion of the blank to be deformed rests horizontally on an anvil 111 having a sharp step of the required depth of the deformation. Above the anvil is pivoted a hammer 112 having a complementary sharp step, and biassed away from the anvil by a spring (not shown). Downward pivoting of the hammer 112 is effected by a cam 113 through a vertically slidable rod 114, whose length can be slightly adjusted to vary the extent of the downward travel of the hammer towards the anvil.

The pivot point of the hammer is arranged so that there is a significant horizontal component in the final movement of the stepped part of the hammer 112. This allows a sharper, better defined internal corner to be produced along the embossed line of the blank, and reduces the tendency of a shear cut along this line which could result if the movement were purely vertical.

Referring next to FIGS. 8 and 9, there is shown the arrangement at station L for initially folding the front walls of the body and lid. A fixed folder 116 is disposed between the stations K and L to fold the front wall 108 of the body upright. The front wall of the lid is also folded upright, but by a pivoting folding device 117 at station L. A pair of fixed rails 118 serve to hold down the base of the body and the top of the lid while the respective front walls are being folded.

Positioned over the bundle 107 at station L is a bundle detector 119. As mentioned above, if this detects a missing bundle, the resultant empty packet is subsequently ejected at station Q.

Referring to FIGS. 10 and 12, when the blank and bundle arrive at station M, a plate folder 120 moves towards the front wall 108 to fold it and the base around the bundle. Immediately afterwards a pivotal folder 121 similarly brings the top and front wall of the lid around the bundle. A holding bar 122 now descends on to the partly formed packet, and holds the two front walls down, while the packet moves under a guide 123 to successive stations N and P (FIG. 13).

At station Q any defective packets may be ejected by a pusher (not shown) into a guide 124. After station R the packet is picked up by an overhead conveyor, and a gumming wheel 109 (FIG. 5) applies three lines of adhesive 109A along each packet flap, as shown in FIG. 14. There are three flaps at each side of the packet, and the wheel 109 is arranged to apply discrete adhesive lines to each of the flaps, so that there is a slight discontinuity of the adhesive lines at the junctions between the flaps, in particular between the outer flap 125 of the lid and the top triangular outer flap 126 of the body. This is arranged by having suitably disposed radial slots across the adhesive-applying peripheral ribs on the wheel 109.

When the packet has been deposited in the drying drum 110 (FIG. 5) stationary folders fold down the flaps against the sides of the packet as the drum is indexed to the next position. The stationary folders are slightly staggered, so that the flaps 125, 126 are folded slightly before the main outer flaps 127 (FIG. 14) of the body. The degree of such staggering may correspond to the thickness of the flaps of the blank.

I claim:

1. A method of erecting a one-piece blank made of a single layer of material of substantially rectangular configuration cut and scored for folding about contents to form a hinged lid packet having a lid portion hinged to a body portion;

(a) wherein said blank comprises:

1. a central portion extending from the top to the bottom of said blank and divided by at least six parallel spaced-apart transverse foldable scored lines into, consecutively from the top to the bottom of said blank, a panel, a front wall, a bottom wall and a rear wall for forming said body portion and a rear wall, a top wall and a front wall for forming said lid portion, the combined length of said panel and front wall of said body portion being substantially the same as the combined length of said rear walls of said body and lid portions; and
2. an outer portion at each of the left and right sides of said central portion, each outer portion comprising a side flap foldably attached to said panel, an outer flap foldably attached to said front wall of said body portion, said side flap having a top edge facing away from said outer flap, an inner flap foldably attached to said rear wall of said body portion, the length of said inner flap of said body portion being greater than the length of said outer flap of said body portion, an inner flap foldably attached to said rear wall of said lid portion and an outer flap foldably attached to said front wall of said lid portion, the bottom edge of said inner flap of said lid portion being coextensive with a straight line coextensive with the foldable scored line between said top wall and rear wall of said lid portion, and the top edge of said inner flap of said lid portion being spaced from said bottom edge thereof, the length of said outer flap of said lid portion being greater than the length of said inner flap of said lid portion;
3. the relative dimensions of said inner flap of said lid portion and said side flap of said body portion of each of said outer portions being such that the distance of said top edge of said inner flap of said lid portion from a straight line coextensive with the foldable scored line between said rear wall and bottom wall of said body portion, said distance being measured parallel to the fold line between said inner flap and said rear wall of said body portion, is at least as great as the distance of said top edge of said side flap of said body portion from a straight line coextensive with the foldable scored line between said front wall and bottom wall of said body portion, said distance being measured parallel to the fold line between said outer flap and said front wall of said body portion, at corresponding locations along the entire lengths of said top edge of said inner flap of said lid portion and said top edge of said side flap of said body portion;

(b) said method comprising the following steps in the recited order:

1. forming said rear wall, bottom wall, front wall, panel and inner flaps of said body portion and said rear wall, top wall, front wall and inner flaps of said lid portion about said contents;

2. folding each of said side flaps of said body portion and securing said side flaps of said body portion to the respective inner flaps of said body portion with said lid portion in closed position;

3. then folding each of said outer flaps of said body and lid portions and securing said outer flaps of said body and lid portions to the respective inner flaps of said body and lid portions with said lid portion maintained in closed position, whereby said top edge of each said side flap of said body portion and the respective top edge of said inner flap of said lid portion confront each other along their entire lengths, and said side flap of said body portion does not overlap said inner flap of said lid portion, said relative dimensions of said respective inner flaps of said lid portion and said side flaps of said body portion assuring that said side flaps of said body portion do not intervene between and are not secured to said inner and outer flaps of said lid portion during said folding and said securing of the respective body and lid portions.

2. A method of erecting a one-piece blank as defined in claim 1 wherein the relative dimensions of said inner flap of said lid portion and said side flap of said body portion of each of said outer portions are such that said distance of said top edge of said inner flap of said lid portion from said straight line coextensive with said foldable scored line between said rear wall and bottom wall of said body portion and said distance of said top edge of said side flap of said body portion from said straight line coextensive with said foldable scored line between said front wall and bottom wall of said body portion are the same at corresponding locations along the entire lengths of said top edge of said inner flap of said lid portion and said top edge of said side flap of said body portion, whereby during the step of forming said rear wall, bottom wall, front wall, panel and inner flaps of said body portion and said rear wall, top wall, front wall and inner flaps of said lid portion about said contents said top edge of each said side flap of said body portion and said respective top edge of said inner flap of said lid portion are caused to abut each other.

3. A method of erecting a one-piece blank made of a single layer of material of substantially rectangular configuration cut and scored for folding about contents to form a hinged lid packet having a lid portion hinged to a body portion;

(a) wherein said blank comprises:

1. a central portion extending from the top to the bottom of said blank and divided by at least six parallel spaced-apart transverse foldable scored lines into, consecutively from the top to the bottom of said blank, a panel, a front wall, a bottom wall and a rear wall for forming said body portion and a rear wall, a top wall and a front wall for forming said lid portion, the combined length of said panel and front wall of said body portion being substantially the same as the combined length of said rear walls of said body and lid portions; and 2. an outer portion at each of the left and right sides of said central portion, each outer portion comprising a side flap foldably attached to said panel, an outer flap foldably attached to said front wall of said body portion, said side flap having a top edge facing away from said outer flap, an inner flap foldably attached to said rear wall of said body portion, the length of said inner flap of said body portion being greater than the length of said outer flap of said body portion, an inner flap foldably attached to said rear wall of said lid portion and an outer flap foldably attached to said front wall of said lid portion, the bottom edge of said inner flap of said lid portion being coextensive with a straight line coextensive with the foldable scored line between said top wall and rear wall of said lid portion, and the top edge of said inner flap of said lid portion being spaced from said bottom edge thereof, the length of said outer flap of said lid portion being greater than the length of said inner flap of said lid portion;

3. the relative dimensions of said inner flap of said lip portion and said side flap of said body portion of each of said outer portions being such that the distance of said top edge of said inner flap of said lid portion from a straight line coextensive with the foldable scored line between said rear wall and bottom wall of said body portion, said distance being measured parallel to the fold line between said inner flap and said rear wall of said body portion, is at least as great as the distance of said top edge of said side flap of said body portion from a straight line coextensive with the foldable scored line between said front wall and bottom wall of said body portion, said distance being measured parallel to the fold line between said outer flap and said front wall of said body portion, at corresponding locations along the entire lengths of said top edge of said inner flap of said lid portion and said top edge of said side flap of said body portion;

(b) said method comprising the following steps in the recited order:

1. forming said rear wall, bottom wall, front wall, panel and inner flaps of said body portion and said rear wall, top wall, front wall and inner flaps of said lid portion about said contents;

2. folding said side and outer flaps of said body portion and said outer flaps of said lid portion simultaneously about opposite sides of said contents with said lid portion in closed position, whereby said top edge of each said side flap of said body portion and the respective top edge of said inner flap of said lid portion confront each other along their entire lengths, and said side flap of said body portion does not overlap said inner flap of said lid portion;

3. securing said side and outer flaps of said body portion to the respective inner flaps of said body portion and securing said outer flaps of said lid portion to the respective inner flaps of said lid portion, said relative dimensions of said respective inner flaps of said lid portion and said side flaps of said body portion assuring that said side flaps of said body portion do not intervene between and are not secured to said inner and outer flaps of said lid portion during said folding and said securing of the respective body and lid portions.

4. A method of erecting a one-piece blank as defined in claim 3 wherein the relative dimensions of said inner flap of said lid portion and said side flap of said body portion of each of said outer portions are such that said distance of said top edge of said inner flap of said lid portion from said straight line coextensive with said foldable scored line between said rear wall and bottom wall of said body portion and said distance of said top edge of said side flap of said body portion from said straight line coextensive with said foldable scored line between said front wall and bottom wall of said body portion are the same at corresponding locations along the entire lengths of said top edge of said inner flap of said lid portion and said top edge of said side flap of said body portion, whereby during the step of forming said rear wall, bottom wall, front wall, panel and inner flaps of said body portion and said rear wall, top wall, front wall and inner flaps of said lid portion about said contents said top edge of each said side flap of said body portion and said respective top edge of said inner flap of said lid portion are caused to abut each other.

* * * * *